US006913023B2

(12) United States Patent
Okamoto et al.

(10) Patent No.: US 6,913,023 B2
(45) Date of Patent: Jul. 5, 2005

(54) FILTER ATTACHING APPARATUS

(75) Inventors: Hiroshi Okamoto, Tokyo (JP); Takayuki Irikura, Kohriyama (JP); Hiroshi Sakuma, Kohriyama (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 10/727,587

(22) Filed: Dec. 5, 2003

(65) Prior Publication Data

US 2004/0112393 A1 Jun. 17, 2004

Related U.S. Application Data

(63) Continuation of application No. PCT/JP02/05709, filed on Jun. 7, 2002.

(30) Foreign Application Priority Data

Jun. 8, 2001 (JP) ..... 2001-174154

(51) Int. Cl.[7] ..... A24C 1/00

(52) U.S. Cl. ..... 131/287; 131/286; 131/94; 131/93; 493/39

(58) Field of Search ..... 131/286, 88, 94, 131/93, 96, 287; 493/39

(56) References Cited

U.S. PATENT DOCUMENTS 3,870,070 A * 3/1975 Kraft ..... 137/512
5,150,719 A 9/1992 Adkins et al.
5,345,950 A * 9/1994 Adebahr et al. ..... 131/69
6,119,698 A 9/2000 Tanigawa et al.
6,371,126 B1 * 4/2002 Korte et al. ..... 131/110

FOREIGN PATENT DOCUMENTS

EP 0 655 402 A1 5/1995
JP 4-49998 U 4/1992

* cited by examiner

*Primary Examiner*—Dionne A. Walls
(74) *Attorney, Agent, or Firm*—Birch, Stewart, Kolasch & Birch, LLP

(57) ABSTRACT

A filter attaching apparatus comprises a drum 20 for conveying an intermediate product of a filter cigarette and a receiving drum 36 for feeding a tip paper piece, and winds the tip paper piece around the intermediate product while rotating these drums with the tip paper piece adhered to the intermediate product. Suction chambers 48 and 50 are disposed in the vicinity of the drum 20 that conveys the intermediate product, and suction openings of the suction chambers extend in a conveying direction of the intermediate product along an outer periphery of the drum 20. Fine particles of shredded tobacco and the like that are scattered by rotation of the drum 20 are sucked through the suction openings into the suction chambers 48 and 50 and the like, so that the intermediate product is completely isolated from an atmosphere of the fine particles of the shredded tobacco and the like.

7 Claims, 5 Drawing Sheets

FILTER ATTACHING APPARATUS

This application is a Continuation of copending PCT International Application No. PCT/JP02/05709 filed on Jun. 7, 2002, which designated the United States, and on which priority is claimed under 35 U.S.C. § 120, and this Non-provisional application claims priority under 35 U.S.C. § 119(a) on Patent Application No(s). 2001-174154 filed in Japan on Jun. 8, 2001, the entire contents of which are hereby incorporated by reference.

TECHNICAL FIELD

The present invention relates to a filter attaching apparatus for aligning a filter plug with cigarettes to form an intermediate product of a double filter cigarette and winding a tip paper piece around the intermediate product to produce the double filter cigarette.

BACKGROUND ART

This kind of filter attaching apparatus is, for example, capable of producing a double filter cigarette by aligning a filter plug having the length equal to two filters with cigarettes to form an intermediate product of a double filter cigarette and winding a tip paper piece around the intermediate product. Specifically, the filter attaching apparatus comprises rotating drum trains for forming and conveying the intermediate products. The filter attaching apparatus further comprises a roll of tip paper and draws out a tip paper web from the roll. Paste is applied to one side of the tip paper web in the drawing process thereof, and then the tip paper web is cut into tip paper pieces on a rotating drum or a receiving drum. The tip paper piece is adhered to the intermediate product on the paste-applied side thereof at the position where the drum train for conveying intermediate products faces the receiving drum, and wound around the outer circumference of the intermediate product by the rolling movement of the product in a rolling passage. The rolling passage is defined, for example, between the receiving drum and a rolling plate. When the intermediate product is fed into the rolling passage, that is, the intermediate product is transferred from the drum train onto the rolling plate, the intermediate product is rolled between the rolling plate and the receiving drum in the feeding direction of tip paper pieces. In this manner, the winding of the tip paper piece connects the filter plug and two cigarettes and forms a double filter cigarette. Thereafter, the double filter cigarette is cut at the center thereof into two filter cigarettes.

In recent years, the conveying speed of intermediate products tends to be made higher and higher in order to improve the productivity of filter cigarettes. As a result, the rotational speed of the drum train for conveying intermediate products also becomes greater, and a considerable inertia acts on cigarettes when the intermediate products are transferred between drums or when the products are carried in the rotating direction of the drums. The inertia causes shredded tobacco, fine particles of thereof, etc. to fall off the cigarettes. As a result, the rotation of the drum scatter the shredded tobacco and the fine particles to form the atmosphere of shredded tobacco and fine particles around the periphery of the intermediate products. If the shredded tobacco or fine particles are deposited on the outer surface of the filter plug or the paste-applied side of the tip paper piece in the atmosphere, the shredded tobacco or fine particles are caught between the tip paper piece and the intermediate product. Once there occurs such intrusion of the shredded tobacco or fine particles, the subject filter cigarettes make defective products, and then every one of them have to be removed.

For this reason, in the technical field of filter attaching apparatus, it is required to prevent defective products of filter cigarettes from being produced due to the intrusion of the shredded tobacco or fine particles thereof, and to realize the prevention is one of the objects of the present invention.

DISCLOSURE OF THE INVENTION

A filter attaching apparatus of the present invention comprises dust-cleaning means disposed along a conveying path for conveying an intermediate product of a filter cigarette. The dust-cleaning means has a suction opening that is located at least a passing area of a filter plug and extends in a path direction of the conveying path, and produces a sucking force through the suction opening.

According to the above-described filter attaching apparatus, shredded tobacco, fine particles thereof, etc. that fall off cigarettes in a process of conveying intermediate products and float around the periphery of the intermediate products, are sucked by the suction opening and removed without depositing on the outer surfaces of the intermediate products. Therefore, the intermediate products are not exposed the atmosphere of the shredded tobacco and fine particles thereof, which makes it possible to wind a clean tip paper piece around the intermediate product. Thus, the filter attaching apparatus of the present invention does not produce defective products of filter cigarettes, thereby greatly contributing to improvement in productivity.

The aforementioned conveying path includes a train of conveying drums that rotate while holding the intermediate products on outer circumferences thereof, and the suction opening is formed into the shape of a circular arc in section along the outer circumference of the conveying drum. In this case, the conveying path is so formed as to curve along the outer circumferential surface of the drum, so that the suction opening is formed to fit the shape of the conveying path. As the shape of the suction opening is adapted to match the outer circumferential surface of the drum, a constant suction force can be always generated around the periphery of the intermediate product on the conveying path, so that there will be no fluctuation in a dust-cleaning performance.

Feeding means of tip paper pieces includes a receiving drum that rotates while sucking one side of the tip paper piece, to which paste is not applied, and causes the tip paper piece to adhere on the intermediate product at a position opposite to the conveying drum. The dust-cleaning means further comprises an exhaust opening for creating airflow along the outer circumferential surface of the receiving drum and forming an air curtain that extends to the passing area of the tip paper pieces, in front of an inlet of a rolling passage. In this case, the tip paper piece is fed by rotation of the receiving drum and wound around the intermediate product on the rolling passage, for example. Although the paste-applied surface of the tip paper piece is exposed on the outer surface of the receiving drum in front of the inlet of the rolling passage, the deposition of the shredded tobacco or fine particles thereof, etc. on the paste-applied surface is prevented by the air curtain. Such combination of the suction opening and the air curtain greatly improves the dust-cleaning performance and makes it possible to feed both the intermediate products and the tip paper pieces to the rolling passage in a clean state.

The suction opening preferably extends up to the front of the inlet of the rolling passage. In this case, the fine particles of the shredded tobacco and the like floating around the periphery of the intermediate products are sucked immediately before the finally winding of the tip paper piece, thus assuring the dust-cleaning of the intermediate products. If the suction opening extends up to the front of the inlet of the rolling passage as described above, the intermediate products are maintained in the clean state until just before the winding of the tip paper pieces.

Moreover, the suction opening may be provided with a porous plate. In this case, since the suction opening sucks the fine particles of the shredded tobacco and the like through small holes of the porous plate, a suction flow rate is heightened around each small hole. Such increasing of the suction flow rate makes it possible to suitably catch and suck minute shredded tobacco.

BEST MODE OF CARRYING OUT THE INVENTION

Figure 1:
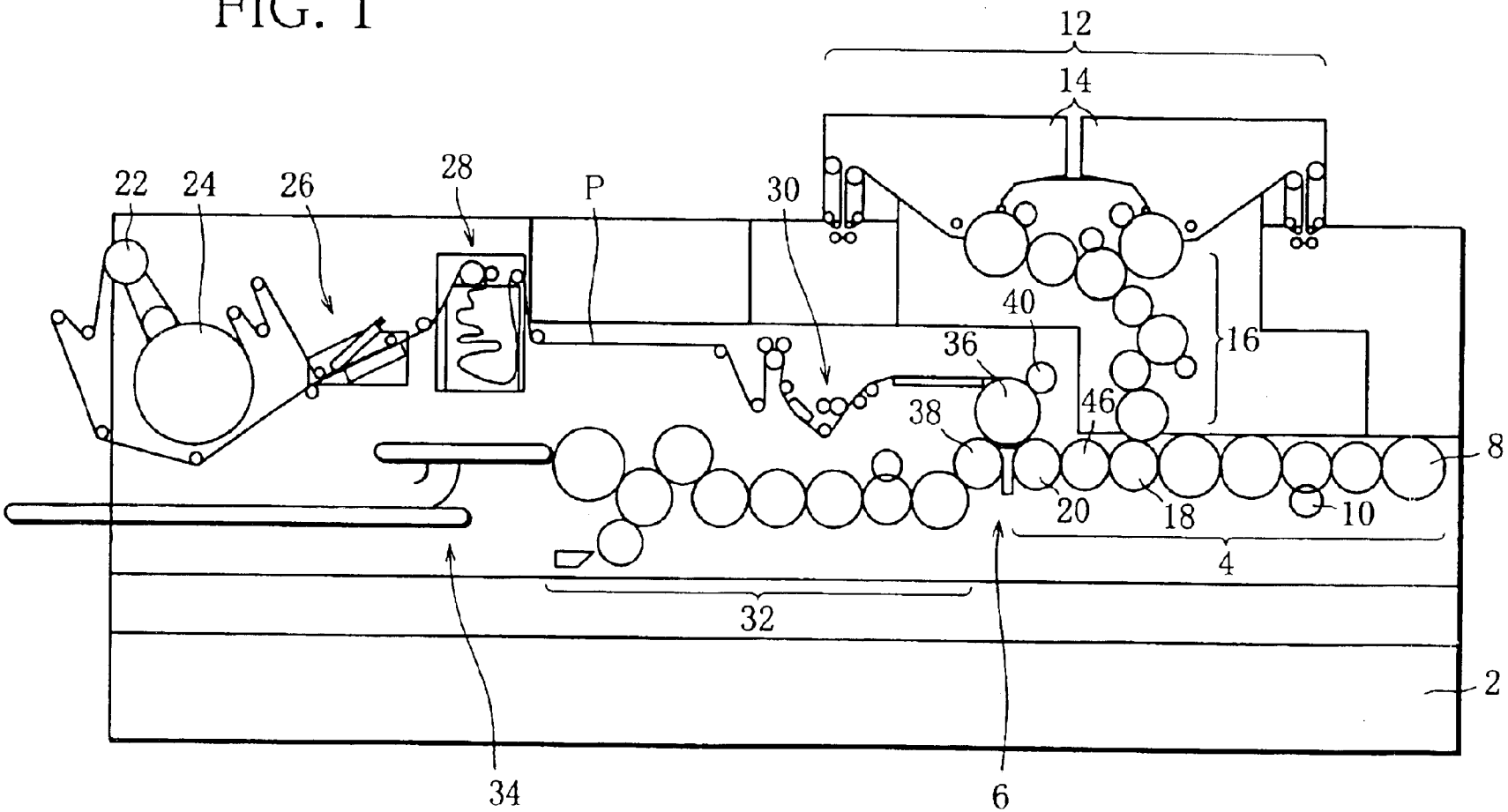
FIG. 1 is a schematic elevation view showing a filter cigarette manufacturing machine.

FIG. 1 schematically illustrates a filter cigarette manufacturing machine in which a filter attaching apparatus of an embodiment is employed. The filter cigarette manufacturing machine has a drum train 4 comprising numbers of conveying drums. The drum train 4 extends in a horizontal direction from an inlet drum 6 located at one end thereof to a rolling section 6. On an outer periphery of each drum, numbers of retention grooves (not shown) are formed at regular intervals in the circumferential direction of the drum, and each drum rotates with cigarettes and filter plugs held in the retention grooves thereof. The cigarettes and filter plugs are transferred between the adjacent drums so that they are conveyed by being sequentially moved from drum to drum. Thus, the drum train 4 forms a conveying path of cigarettes and filter plugs, or filter cigarette intermediate products.

The inlet drum 6 is supplied with a double length cigarette having a length equal to two single cigarettes, for example, from a cigarette manufacturing apparatus or a cigarette reservoir (not shown). The double length cigarette is cut into two single cigarettes by a rotary knife 10 in the middle of the drum train 4, and then the single cigarettes are separated from each other in an axial direction thereof.

Disposed above the drum train 4 is a plug feeding device 12. The plug feeding device 12 has a pair of rod hoppers 14 arranged side by side. These rod hoppers stores numbers of filter rods. A filter rod has a length equal to two or three filter plugs and is fed from a filter feeding device, not shown, through a pneumatic transfer pipe to the plug feeding apparatus 12. A drum train 16 extends from outlets of the rod hoppers 14 and is connected to an assembly drum 18 located in the drum train 4. The drum train 16 takes the filter rods one by one out of the rod hoppers 14 and feeds the filter rods toward the assembly drum 18. In this feeding process, each filter rod is cut into two or three filter plugs, subjected to grading, lining arrangement and the like, and then sequentially fed as an individual filter plug to the assembly drum 18. On the assembly drum 18, there are two single cigarettes aligned in the axial direction thereof with space therebetween, and the fed filter plug is located between the single cigarettes.

Thereafter, the two single cigarettes on the next drum are moved to a center of the next drum, thus forming an intermediate product of a double filter cigarette in which single cigarettes are closely contacted to the corresponding end of the filter plug. The intermediate product is fed to the rolling section 6 via an outlet drum 20 located at the left end of the drum train 4.

The filter cigarette manufacturing machine comprises rolls 22 and 24 of tip paper web P, and a feeding path of the tip paper web P extends from the rolls 22 and 24 to the rolling section 6. The rolls 22 and 24 are disposed in an upper left end portion of a main frame 2 of the machine, and the roll 22 is in use, while the roll 24 on standby. The tip paper web P drawn out from the roll 22 is guided to the rolling section 6 by numbers of guide rollers located on the feeding path. In the middle of the feeding path, there are disposed a tip-connecting device 26 and a reservoir box 28 for the use of exchange of an active roll, a paste-applying device 30 for applying paste to one side of the tip paper web P, and the like, in order from the upper stream side of the feeding path.

The tip paper web P fed toward the rolling section 6 is cut in a prescribed length to be tip paper pieces. These tip paper pieces are affixed to and sequentially wound around the respective intermediate products of double filter cigarettes that are fed from the drum train 4. At this moment, each tip paper piece is wound around a portion of the product that ranges from the filter plug of the intermediate product to end portions of the single cigarettes on both sides, and adhered to this portion so as to integrally wrap the same, thereby forming a double filter cigarette with the single cigarette connected to each end of the filter plug.

The obtained double filter cigarette is fed to a drum train 32 extending from the rolling section 6 and continues conveyed on the drum train 32. In the conveying process, the double filter cigarette is cut at a center thereof by the rotary knife to be two filter cigarettes, and then the two filter cigarettes are separated from each other in an axial direction and conveyed. Thereafter, the filter cigarettes are individually subjected to quality inspections for the fall-off of the shredded tobacco from the cigarette ends thereof, air permeability, etc., and the filter cigarettes determined to be defective are removed from the drum train 32. A conveyer 34 is connected to a terminal end of the drum train 32. The conveyer 34 receives the filter cigarettes from the drum train 32, directs the filter cigarettes in the same orientation, and then conveys the filter cigarettes toward a packing apparatus, not shown.

Figure 2:
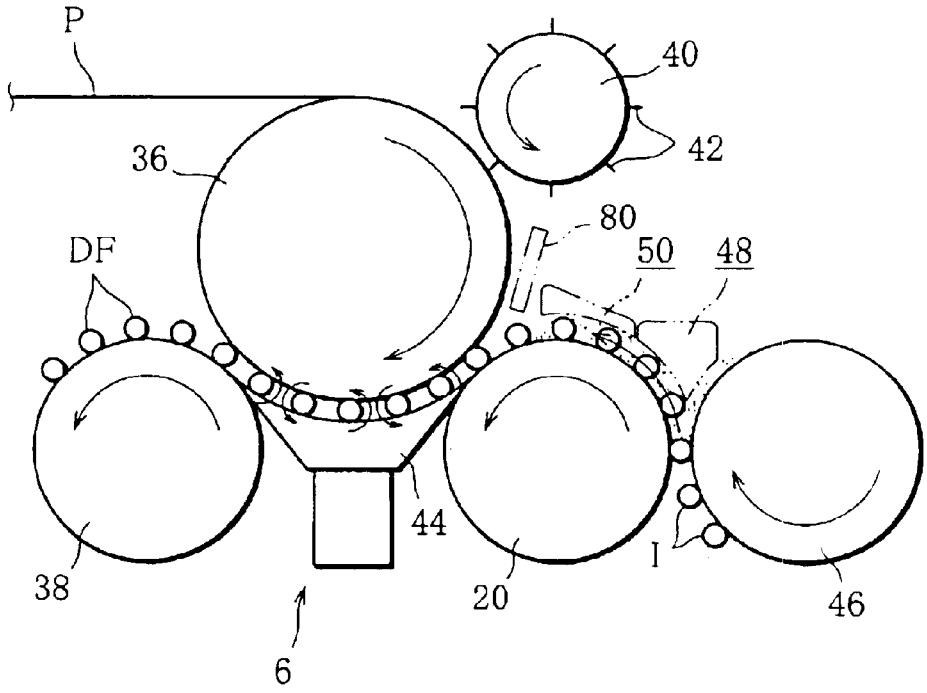
FIG. 2 is an enlarged view showing a rolling section in FIG. 1.

FIG. 2 is an enlarged view of the above-described rolling section 6. The rolling section 6 comprises a receiving drum 36 and is fed with the tip paper web P on an outer periphery thereof. The receiving drum 36 is located above the outlet drum 20 of the drum train 4 and an inlet drum 38 of the drum train 32 so as to connect the outlet drum 20 and the inlet drum 38.

The outer periphery of the receiving drum 36 has width slightly greater than a whole length of the intermediate product I of a double filter cigarette, and a central portion in the width direction of the outer periphery is formed as a suction surface over all the periphery. Therefore, the tip paper web P guided through the feeding path is sucked and attracted onto the suction surface of the receiving drum 36 with the paste-applied side of the web P facing the outside. The receiving drum 36 rotates in an opposite direction against the outlet drum 20 and feeds the tip paper web P with the rotation thereof.

A bladed drum 40 is adjacently disposed at the upper right of the receiving drum 36 and rotates in the opposite direction against the receiving drum 36. Knives 42 are projectingly disposed on an outer periphery of the bladed drum 40 at regular intervals in a circumferential direction. While rotating, the bladed drum 40 cuts the tip paper web P into tip paper pieces of a predetermined length on the outer periphery of the receiving drum 36 in cooperation with the drum 36.

Below the receiving drum 36, there is disposed a rolling plate 44 having an upper surface formed into the shape of a circular arc along the outer periphery of the receiving drum 36. A rolling passage is defined between the rolling plate 44 and the receiving drum 36 and curved downward. The rolling passage has height slightly smaller than a diameter of the intermediate product I.

When the intermediate product I is fed to an inlet of the rolling passage, the intermediate product I runs on to the rolling plate 44 and begins to roll. With the rotation of the receiving drum 36, the tip paper piece, not clearly shown, that is sucked and attracted to the outer periphery of the receiving drum 36, enters the rolling passage in synchronization with the rolling movement of the intermediate product I and a front edge of the paste-applied side of the tip paper piece is adhered to the outer circumference of the intermediate product I. The intermediate product I with the tip paper piece adhered thereto rolls in the rolling passage due to friction against the rolling plate 44. With the rolling movement, the tip paper piece is wound around the outer circumference of the intermediate product I. At this moment, the receiving drum 36 releases a sucking force with respect to the tip paper piece in the rolling passage, so that the tip paper piece can be smoothly detached from the outer periphery of the receiving drum 36 when being wound around the intermediate product I. The intermediate product I, for example, rotates about three times in the rolling passage so that the adhesion of the tip paper piece to the product I is ensured. Thereafter, the intermediate product is delivered from the rolling passage. When the winding of the tip paper piece is finished, a double filter cigarette DF is obtained as described above.

The aforementioned are the details of process of winding a tip paper piece around the intermediate product I. In the process, the fine particles of shredded tobacco and the like that fall off the cigarettes, for example, are scattered and float around the periphery of the intermediate product I in the vicinity of the outlet drum 20. If the fine particles of the shredded tobacco and the like deposited on the intermediate product I or the tip paper piece on the receiving drum 36, the fine particles or shredded tobacco get caught in the inside of the tip paper piece wounded. Occasionally, the floating fine particles of the shredded tobacco fly into space between the intermediate product I and the tip paper piece in the winding process of the tip paper piece so that they are caught.

More specifically, after receiving the intermediate product I from a drum 46 located in an upper stream of the outlet drum 20, the outlet drum 20 conveys the intermediate product I in a rotational direction at a high speed while urging the intermediate product I upward from a receiving position between the drum 46 and the outlet drum 20. At this moment, as shown by an arrow in the drawing, the fine particles of shredded tobacco and the like are stirred up in the conveying direction of the intermediate product I and scattered in all directions around the periphery of the intermediate product I. Among the scattered fine particles and the like, heavy ones occasionally fall straight and are deposited on the outer surface of the intermediate product I, whereas light ones sometimes float to reach the receiving drum 36. Otherwise, the fine particles of shredded tobacco sometimes fall off the ends of the cigarettes while the cigarettes are conveyed on the drum train 4 and float around the periphery of the intermediate product I. Therefore, the filter attaching apparatus of the present embodiment comprises equipment for cleaning such fine particles of shredded tobacco and the like near the rolling section 6.

Figure 3:
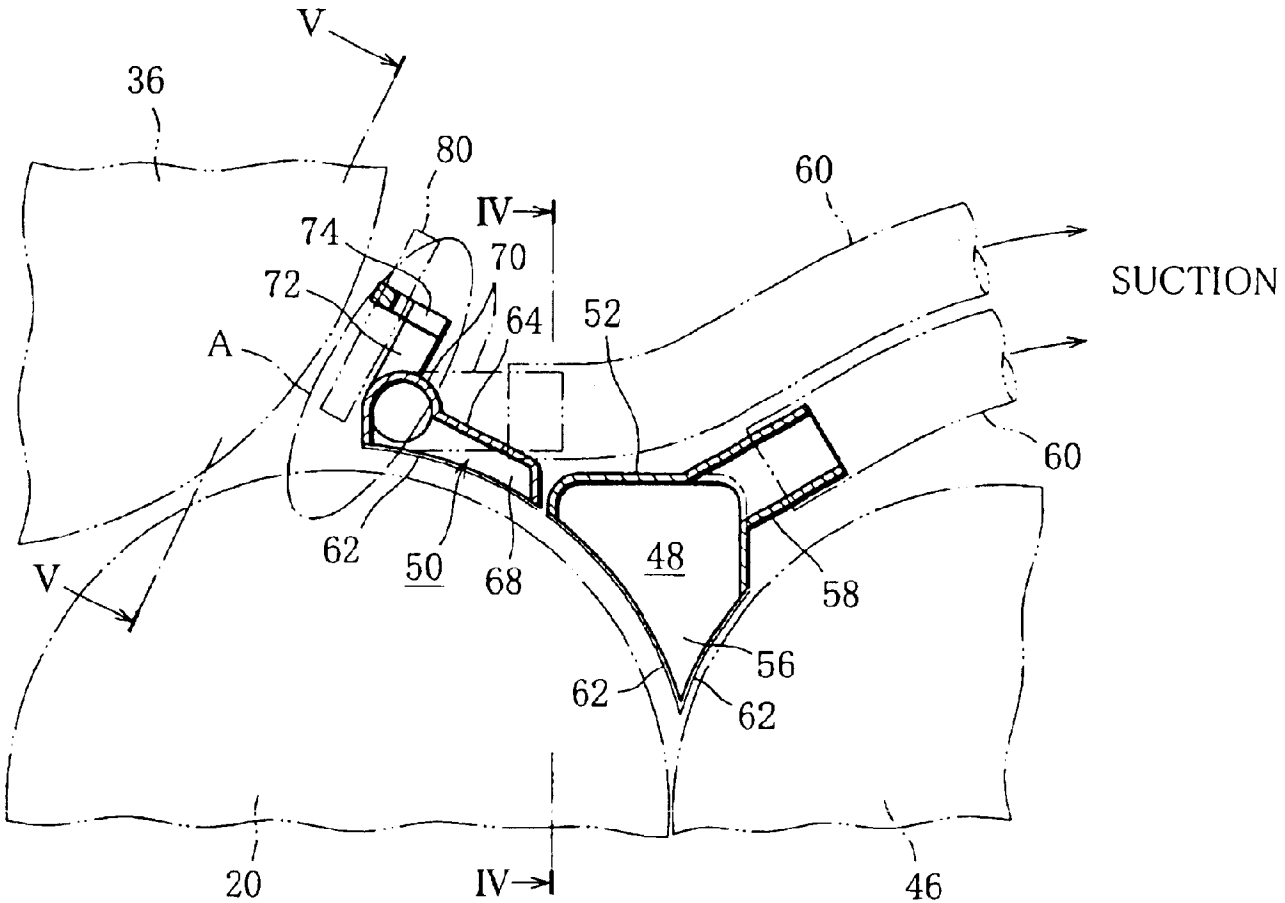
FIG. 3 is a sectional view showing suction chambers and the vicinity thereof in detail.

FIG. 3 illustrates the above dust-cleaning equipment in detail and more specifically shows two suction chambers 48 and 50 of the dust-cleaning equipment in section. The suction chamber 48 is located between the outlet drum 20 and the drum 46 located in the upper stream of the outlet drum 20, and has an opening that faces the outer peripheries of the drums 20 and 46. The suction chamber 50 is located above the outlet drum 20 and has a downward opening that faces the outer periphery of the outlet drum 20. The openings of the suction chambers 48 and 50 are adjacently located to each other in a rotational direction of the outlet drum 20, namely a conveying path direction of the intermediate product I.

Figure 4:
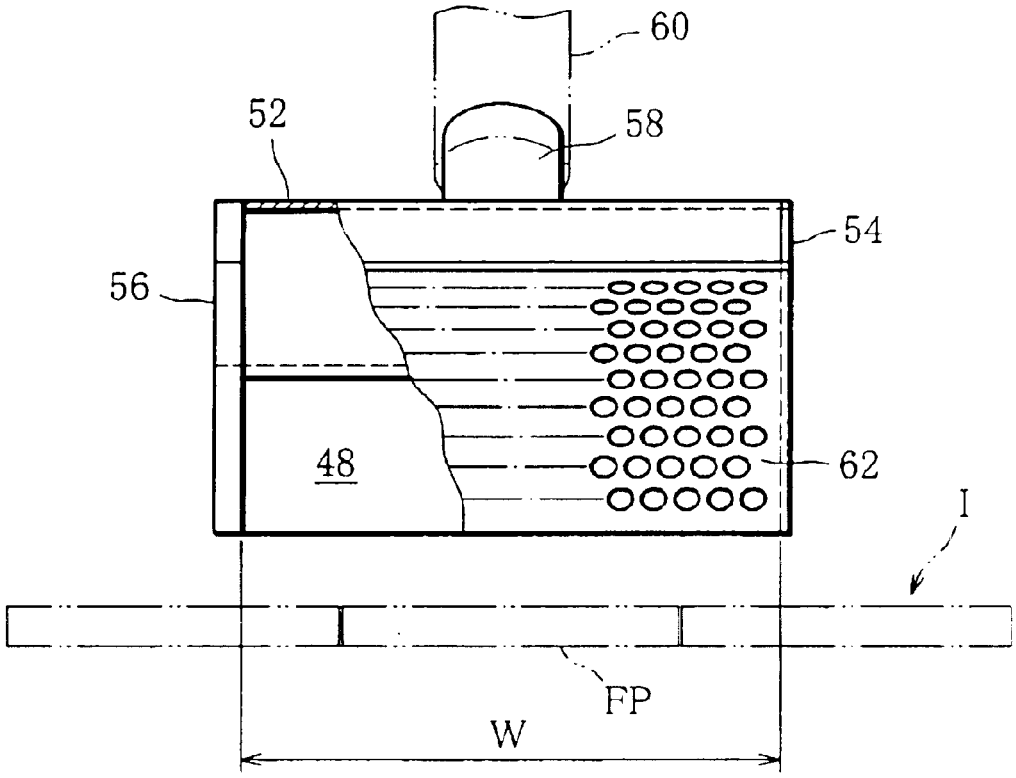
FIG. 4 is a view showing the suction chamber from the left side of line IV—IV of FIG. 3.

FIG. 4 illustrates only one of the two suction chambers, that is, the suction chamber 48 described above. Hereinafter, the suction chamber 48 will be explained in detail with reference to FIGS. 3 and 4.

The suction chamber 48 has a hood plate 52 for providing a ceiling thereof, the hood plate 52 being formed into a channel in section as shown in FIG. 3. A pair of side walls 54 and 56 is fixed on both sides of the hood plate 52, respectively, with respect to the rotational direction of the drum train, and the suction chamber 48 is defined between the side walls 54 and 56. The side walls 54 and 56 extend downward from the hood plate 52 so as to be interposed in a gap (valley) between the outlet drum 20 and the drum 46. Therefore, lower ends of the side walls 54 and 56 are formed into a tapering shape to match with the gap. In other words, the side walls 54 and 56 has lower edges extending from the lower ends thereof so that the lower edges shape into a V and are formed into the shape of a circular arc along the outer peripheries of the outlet drum 20 and the drum 46, respectively. Accordingly, when the opening of the suction chamber 48 is brought to face the outlet drum 20 and the drum 46, it is obvious that the opening thereof is formed into the shape of a circular arc in section along the outer peripheries of the outlet drum 20 and the drum 46.

On the hood plate 52, a nozzle 58 is mounted so as to protrude diagonally above the hood plate 52. The nozzle 58 communicates with the suction chamber 48. A suction hose 60 is connected to the nozzle 58 so that suction pressure is supplied into the suction chamber 48 from a suction source, not shown. Thus, the opening of the suction chamber 48 serves as a suction opening that faces the outer peripheries of the outlet drum 20 and drum 46, which makes it possible to produce a sucking force through the suction opening.

As shown in FIG. 4, a punching metal 62 is fixed to the opening of the suction chamber 48, or the suction opening. The punching metal 62 is subjected to a bending process in accordance with curvature of the opening. Utilized for the punching metal 62 is, for example, a product in which circular holes are punched in a zigzag of 60°.

Figure 5:
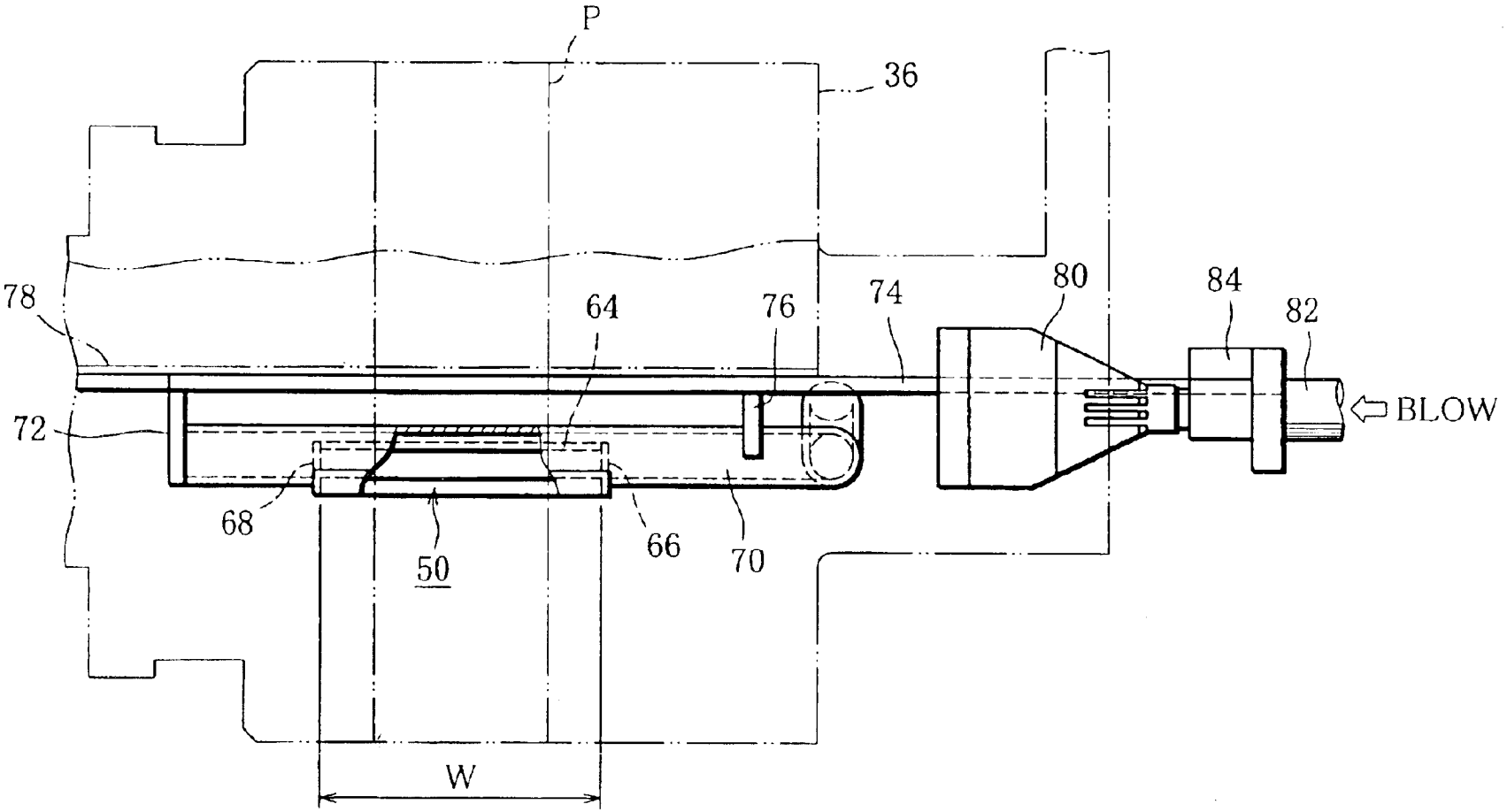
FIG. 5 is a view showing the suction chamber from the left side of line V—V of the FIG. 3.

FIG. 5 shows the other suction chamber, namely the suction chamber 50. The suction chamber 50 will be described below with reference to FIGS. 3 and 5.

The suction chamber 50 has a hood plate 64 above the outlet drum 20, the hood plate 64 extending along the outer periphery of the outlet drum 20. There are provided a pair of side walls 66 and 68 on both sides of the hood plate 64, respectively, in the rotational direction of the outlet drum 20. The suction chamber 50 is formed between the side walls 66 and 68. Lower edges of the side walls 66 and 68 are formed into the shape of a circular arc along the outer periphery of the outlet drum 20, so that the opening of the suction chamber 50 is also formed into the shape of a circular arc in section along the outer periphery of the outlet drum 20.

Disposed above the outlet drum 20 is a suction pipe 70 extending in the axial direction of the outlet drum 20 at the position in front of the inlet of the rolling passage. The hood plate 64 is connected to a circumferential wall of the suction pipe 70. The hood plate 64 and side walls 66 and 68 are likewise connected to the side wall of the suction pipe 70, and the circumferential wall of the suction pipe 70 is notched in a portion located in the suction chamber 50. The suction pipe 70 is blocked at one end thereof by an end plate 72, and the other end is bent in the opposite direction against the rotational direction of the outlet drum 20. The bent end is connected to the suction hose 60 so that the suction pressure is supplied into the suction chamber 50 as well. Therefore, the opening of the suction chamber 50 serves as a suction opening that faces the outer periphery of the outlet drum 20, and the sucking force can be produced through the suction opening. Moreover, the punching metal 62 is fixed to the suction opening of the suction chamber 50 in the same manner.

Disposed above the suction pipe 70 is a bracket 74 extending in the axial direction of the suction pipe 70. The suction pipe 70 is connected to an end of the bracket 74 via the end plate 72 that blocks up one end of the suction pipe 70, and further connected to the bracket 74 via a lug 76 at a front side of the apparatus. Moreover, an upper surface of the bracket 74 is fixed to a frame member 78 of the apparatus.

FIG. 5 illustrates an air blow nozzle 80 as another dust-cleaning equipment. The air blow nozzle 80 is a so-called fishtail type, and numbers of nozzle holes (not shown) are formed at a distal end of the air blow nozzle 80 along a straight line. The air blow nozzle 80 is connected to a blow pipe 82, and the blow pipe 82 is supplied with blow air from an air pressure source, not shown. The other end of the bracket 74 projects toward the front side of the apparatus, and a holder block 84 is fixed in a distal end portion of the bracket 74. The blow pipe 82 is held to or clamped by the holder block 84 and is fixed to the frame member 78 through the bracket 74, together with the air blow nozzle 80.

Each nozzle holes of the air blow nozzle 80 is directed to the back side of the apparatus, and the nozzle holes are arranged in a line. As shown by a chain double-dashed line in FIG. 3, the line of the nozzle holes extends in a direction along the outer periphery of the receiving drum 36. Therefore, simultaneous blowout of air from each nozzle hole of the air blow nozzle 80 produces airflow moving along the outer periphery of the receiving drum 36 toward the back side of the apparatus. The airflow advances in a direction crossing a feeding direction of the tip paper web P to form an air curtain that covers a passing area of tip paper pieces in front of the inlet of the rolling passage. An effective range of the air curtain that is formed by the airflow is shown as area A encircled by a dashed line in FIG. 3. Since the area A is located slightly away from the passing area of the intermediate product I that is actually conveyed, there occurs no disturbance in the conveyance of the intermediate product I, that is attributable to the air curtain.

As illustrated in FIG. 4, width W of the suction opening is greater than length of a filter plug portion FP of the intermediate product I. The suction opening of the suction chamber 50 has the same width W, and the width W of each suction opening is greater than width of tip paper web P as shown in FIG. 5. Both the suction openings of the suction chambers 48 and 50 are arranged adjacently in the rotational direction of the outlet drum 20 and located above an passing area of the filter plug portion FP on the outlet drum 20. Moreover, the two suction openings extend in the conveying direction of the intermediate product I along the outer periphery of the outlet drum 20, and a terminal end thereof reaches the front of the inlet of the rolling passage (refer to FIG. 3).

When the intermediate product I of a double filter cigarette is conveyed by the outlet drum 20 as described above, the fine particles of the shredded tobacco and the like, that are scattered around the periphery thereof, are sucked through the suction openings of the suction chambers 48 and 50 and collected through the suction hose 60. The suction hose 60 is connected to a dust collector, not shown, and the sucked fine particles and the like are appropriately dealt from the dust collector. At the moment, since the suction opening overlaps the passing area of the filter plug portion FP, and moreover the width W thereof is still greater than the width of the tip paper web P, the intermediate product I is completely isolated from the atmosphere of the fine particles of the shredded tobacco and the like especially in the vicinity of a winding area of tip paper pieces.

Furthermore, since the suction opening extends up to the front of the inlet of the rolling passage, the intermediate product I is completely isolated from the atmosphere of the fine particles of the shredded tobacco and the like all the way to a position immediately before the intermediate product I is entered from the outlet drum 20 to the rolling plate 44. As a result, the intermediate product I can be sent onto the rolling passage in the clean state, which effectively prevents defective products from being produced. Furthermore, even if the fine particles of the shredded tobacco and the like are deposited on the filter plug portion FP by any chance, the fine particles of the shredded tobacco and the like are sucked right before the inlet of the rolling passage and eventually removed from the intermediate product I.

On the other hand, when a tip paper piece is fed by the receiving drum 36, the fine particles and the like flying toward the paste-applied side of the tip paper piece are interrupted by the air curtain just before the tip paper piece. Thus, there is no fine particle of the shredded tobacco and the like that is deposited on the paste-applied side of the tip paper piece, so that the tip paper piece can be fed to the intermediate product I in the clean state.

Furthermore, because of the punching metal 62 fixed to each suction opening, a suction flow velocity is heightened around each small hole of the punching metal 62. Thus, the suction chambers 48 and 50 can securely suck even minute shredded tobacco, and the dust-cleaning performance thereof is improved.

The present invention is not limited to the above embodiment and may be embodied with various modifications.

Although, in the filter cigarette manufacturing machine shown in FIG. 1, the rolling passage for the intermediate product I is formed between the receiving drum 36 and the rolling plate 44, a rolling passage may be independently provided between a rolling drum and a rolling hand.

Specifically, a receiving drum is disposed in the vicinity of a drum located in the upper stream of the rolling drum, and the intermediate product of a double filter cigarette is fed with a tip paper piece on the drum located in the upper stream of the rolling drum. The intermediate product that is fed with the tip paper piece is rolled on an outer periphery of the rolling drum while being guided by the rolling hand. Therefore, a suction chamber is disposed in the vicinity of the drum located in the upper stream of the rolling drum, and an air curtain is formed near a position where the drum located in the upper stream from the air curtain and the receiving drum face each other.

Although the above embodiment shows the case that the intermediate product I is fed to the rolling plate 44 via an upper half periphery of the outlet drum 20, the conveying path of the intermediate product I may be formed on a lower half periphery of the outlet drum 20.

In the above embodiment, the suction chambers 48 and 50 are provided as two individual parts but may be formed integrally. Moreover, the suction openings of the respective suction chambers are not necessarily located exclusively near the outlet drum 20 but may be located in the vicinity of the drum 46 or another drum in the drum train 4 that is disposed in the upper stream of the outlet drum 20.

The suction chambers 48 and 50 in the above embodiment are located above the outer periphery of the outlet drum 20 and the like, that is, on the outer side of the passing area of the intermediate product I with respect to the outlet drum 20 and the like. On the contrary, another suction chamber may be independently disposed on the inner side of the passing area of the intermediate product I. Specifically, a plurality of support portions for sucking and holding the intermediate product I are formed on the outer periphery of the outlet drum 20 at intervals in an axial direction thereof, and the support portions are so formed as to protrude from the outer periphery of the outlet drum 20. Each intermediate product I is sucked and held in a retention groove formed in the support portion and conveyed with the rotation of the outlet drum 20. At the moment, a groove is formed between the adjacent support portions in the circumferential direction of the outlet drum 20, and thus space is secured between the outer periphery of the outlet drum 20 and the conveyed intermediate product I. Therefore, it is possible to suck the fine particles of the shredded tobacco and the like on the inner side of the passing area of the intermediate product I with respect to the outlet drum 20 if the another suction chamber is disposed in the space. In this case, a suction surface of the another suction chamber is in the shape of a circular arc in section that is directed outside the outlet drum 20.

Moreover, a concrete specification of the punching metal 62 is not limited to the 60°-zigzag-punching of circular holes. A pitch, shape, alignment of the holes and the like may be suitably changed. In addition, a direction of the airflow forming the air curtain, and length, width and the like of the air curtain may be suitably altered according to a position, size, shape and the like of the receiving drum and the like.

Suction holes are formed on a bottom of the retention groove, and a suction passage is formed in the support portion from each suction hole. The suction passages communicate with a suction chamber in the outlet drum 20 or the like, and the intermediate products I are sucked through the respective suction holes. Although an opening area of the suction holes is generally determined to be the same as a cross sectional area of the suction passage, the shredded tobacco caught between the retention groove and the intermediate product I can be sucked if the opening area of the suction holes is enlarged on the bottom of the retention groove. In this case, it is possible to remove even the shredded tobacco that cannot be sucked by the suction chambers 48 and 50 and the like.

Needless to say, various members composing the suction chambers 48 and 50 and the air blow nozzle 80 may be suitably changed in concrete shape, specification and the like.

What is claimed is:

1. A filter attaching apparatus comprising:

a conveying path for conveying an intermediate product of a filter cigarette in which a cigarette and a filter are aligned with each other in an axial direction thereof, feeding means for feeding a tip paper piece, in which paste is applied to one side thereof, along a prescribed feeding path and affixing the tip paper piece to the intermediate product, a rolling passage adapted to connect to said conveying path, said rolling passage causing the conveyed intermediate product to roll in a feeding direction of the tip paper piece and winding the tip paper piece around the intermediate product to form a filter cigarette, and dust-cleaning means located along said conveying path, said dust-cleaning means having a suction opening that overlaps at least a passing area of the filter and extends in a path direction of said conveying path, and producing a sucking force through the suction opening, wherein said conveying path includes a train of conveying drums that rotate while holding the intermediate product on respective outer peripheries thereof, and said suction opening is formed into the shape of a circular arc in section along the outer circumference of said conveying drum.

2. The filter attaching apparatus according to claim 1, wherein said feeding means includes a receiving drum that rotates while sucking the other side of the tip paper piece and affixes the tip paper piece to the intermediate product at a position opposite to said conveying drum, and said dust-cleaning means further has a nozzle hole that generates airflow along the outer periphery of said receiving drum to form an air curtain covering a passing area of the tip paper piece immediately before an inlet of said rolling passage.

3. The filter attaching apparatus according to claim 1, wherein said suction opening extends up to the front of an inlet of said rolling passage and is provided with a porous plate.

4. A filter attaching apparatus, comprising:

a conveying path for conveying an intermediate product of a filter cigarette in which a cigarette and a filter are aligned with each other in an axial direction thereof, feeding means for feeding a tin paper piece, in which paste is applied to one side thereof, along a prescribed feeding path and affixing the tip paper piece to the intermediate product, a rolling passage adapted to connect to said conveying path, said rolling passage causing the conveyed intermediate product to roll in a feeding direction of the tip paper piece and winding the tip paper piece around the intermediate product to form a filter cigarette, and dust-cleaning means located along said conveying path, said dust-cleaning means having a suction opening that overlaps at least a passing area of the filter and extends in a path direction of said conveying path, and producing a sucking force through the suction opening, wherein said suction opening extends up to the front of an inlet of said rolling passage.

5. The filter attaching apparatus according to claim 4, wherein said conveying path includes a train of conveying drums that rotate while holding the intermediate product on respective outer peripheries thereof, and said suction opening is formed into the shape of a circular arc in section along the outer circumference of said conveying drum.

6. A filter attaching apparatus, comprising:

a conveying path for conveying an intermediate product of a filter cigarette in which a cigarette and a filter are aligned with each other in an axial direction thereof, feeding means for feeding a tip paper piece, in which paste is applied to one side thereof, alone a prescribed feeding path and affixing the tip paper piece to the intermediate product, a rolling passage adapted to connect to said conveying path, said rolling passage causing the conveyed intermediate product to roll in a feeding direction of the tip parer piece and winding the tip paper piece around the intermediate product to form a filter cigarette, and dust-cleaning means located along said conveying path, said dust-cleaning means having a suction opening that overlays at least a passing area of the filter and extends in a path direction of said conveying path, and producing a sucking force through the suction opening, wherein said suction opening is provided with a porous plate.

7. The filter attaching apparatus according to claim 6, wherein said conveying path includes a train of conveying drums that rotate while holding the intermediate product on respective outer peripheries thereof, and said suction opening is formed into the shape of a circular arc in section along the outer circumference of said conveying drum.

* * * * *